US010870186B2

(12) United States Patent
Ross

(10) Patent No.: US 10,870,186 B2
(45) Date of Patent: Dec. 22, 2020

(54) DUAL PAWL RATCHET MECHANISM AND REVERSING METHOD

(71) Applicant: Snap-on Incorporated, Kenosha, WI (US)

(72) Inventor: David T. Ross, Beach Park, IL (US)

(73) Assignee: Snap-on Incorporated, Kenosha, WI (US)

( * ) Notice: Subject to any disclaimer, the term of this patent is extended or adjusted under 35 U.S.C. 154(b) by 189 days.

(21) Appl. No.: 15/719,055

(22) Filed: Sep. 28, 2017

(65) Prior Publication Data

US 2019/0091839 A1 Mar. 28, 2019

(51) Int. Cl.
*B25B 13/46* (2006.01)
*B25B 23/00* (2006.01)

(52) U.S. Cl.
CPC ..... *B25B 13/463* (2013.01); *B25B 23/0035* (2013.01)

(58) Field of Classification Search
CPC ... B25B 13/463; B25B 23/0035; B25B 13/48; B25B 13/481; B25B 13/5091; B25B 17/00; B25B 13/46; B25B 23/00; E21B 19/16
See application file for complete search history.

(56) References Cited

U.S. PATENT DOCUMENTS

| | | | | |
|---|---|---|---|---|
| 1,060,185 | A | 4/1913 | Hitt | |
| 1,414,989 | A | 5/1922 | McCaskey | |
| 2,978,081 | A * | 4/1961 | Lundin | B25B 13/463 192/43.1 |
| 3,332,295 | A | 7/1967 | Cummings, Jr. | |
| 5,174,176 | A | 12/1992 | Krivec | |
| 5,782,147 | A | 7/1998 | Chaconas | |
| 5,873,286 | A | 2/1999 | Van Lenten | |
| 6,382,052 | B1 | 5/2002 | Chen | |
| 7,424,837 | B2 | 9/2008 | Shu | |
| 7,765,896 | B1 | 8/2010 | Chen | |
| 8,499,666 | B2 | 8/2013 | Hopper | |
| 9,079,299 | B2 | 7/2015 | Wu | |
| 2006/0123954 | A1 | 6/2006 | Arnold | |
| 2006/0213334 | A1 | 9/2006 | Lee | |
| 2006/0272455 | A1 | 12/2006 | Patel et al. | |
| 2008/0210061 | A1 | 9/2008 | Yu | |

(Continued)

FOREIGN PATENT DOCUMENTS

| | | |
|---|---|---|
| CN | 101275653 A | 10/2008 |
| CN | 203357339 | 12/2013 |

(Continued)

OTHER PUBLICATIONS

UK Combined Search and Examination Report for Application No. GB1810304.4 dated Dec. 13, 2018, 7 pages.
Australian Examination Report No. 1 for Application No. 2018204498 dated Mar. 22, 2019, 6 pages.
Taiwan Office Action for Application No. 107134132, dated Oct. 16, 2019, 5 pages.

(Continued)

*Primary Examiner* — Robert J Scruggs
(74) *Attorney, Agent, or Firm* — Seyfarth Shaw LLP

(57) ABSTRACT

A dual-pawl ratchet wrench mechanism is disclosed having a pawl carrier for selectively engaging a ratchet gear in first and second drive directions. The pawl carrier is operatively coupled to at least one pawl. The pawl carrier including at least one recess that at least partially houses the at least one pawl. The at least one pawl being rotatable about a central portion thereof within the recess when the pawl carrier is operated between the first and second drive directions.

12 Claims, 5 Drawing Sheets

(56) References Cited

U.S. PATENT DOCUMENTS

| | | | | |
|---|---|---|---|---|
| 2008/0229887 | A1 | 9/2008 | Thompson et al. | |
| 2008/0229889 | A1* | 9/2008 | Hopper | B25B 13/463 81/63.1 |
| 2012/0186400 | A1 | 7/2012 | Elger | |
| 2013/0118317 | A1 | 5/2013 | Chang | |
| 2013/0276592 | A1 | 10/2013 | Sroka | |
| 2013/0283982 | A1 | 10/2013 | Hopper et al. | |
| 2014/0208897 | A1 | 7/2014 | Kao | |

FOREIGN PATENT DOCUMENTS

| | | |
|---|---|---|
| DE | 20016719 U1 | 11/2000 |
| GB | 820914 | 9/1959 |
| GB | 2447765 | 9/2008 |
| TW | 201529241 | 8/2015 |
| TW | M523547 | 6/2016 |

OTHER PUBLICATIONS

Taiwan Office Action for Application No. 107134132 dated May 30, 2019, 19 pages.
Canadian Office Action for Application No. 3,010,643, dated Jul. 10, 2019, 3 pages.
Examination Report for Application No. GB1810304.4 dated Nov. 22, 2019, 4 pages.
Chinese Office Action for Application No. 201810948788.7 dated Mar. 23, 2020, 12 pages.
Examination Report for Application No. GB1810304.4 dated Mar. 18, 2020, 4 pages.
Taiwan Office Action for Application No. 10920392470 dated Apr. 28, 2020, 13 pages.
Canadian Office Action for Application No. 3,010,643 dated Apr. 20, 2020, 3 pages.

* cited by examiner

DUAL PAWL RATCHET MECHANISM AND REVERSING METHOD

TECHNICAL FIELD OF THE INVENTION

The present invention relates generally to dual pawl ratchet mechanisms. More particularly, the present invention relates to an improved reversible dual pawl device and method.

BACKGROUND OF THE INVENTION

Currently many dual pawl ratchet mechanisms are known and used. Typically, these mechanisms are incorporated into tools, such as wrenches and/or screwdrivers, or the like, so that there is a drive portion engageable with, for example, a bolt head. A first drive direction may be selected for the dual pawl ratchet mechanism so that use of the tool provides torque when engaged with the bolt head and rotated in a first direction while slipping or ratcheting when rotated in a second direction. A second drive direction may be selected for the dual pawl ratchet mechanism that is opposite the first drive direction, and that provides torque and slip in the opposite directions.

In operating the reversible dual pawl mechanism, there is typically a manually actuable portion, commonly referred to as a reversing lever, that effects the engagement of one pawl and the disengagement of a second pawl. The drive direction for the drive portion is dependent on which of the two pawls is engaged.

SUMMARY OF THE INVENTION

The present disclosure provides a fine tooth ratchet wrench including a pawl mechanism for selectively engaging a ratchet gear in first and second drive directions. The pawl mechanism includes a pawl carrier operably coupled to at least one pawl. The pawl carrier includes at least one recess that at least partially houses the at least one pawl. The at least one pawl is rotatable about a central portion thereof within the recess when the pawl mechanism is operated between the first and second drive directions. The present disclosure allows for fine tooth, and other, ratchet wrenches to be manufactured with less cost and complexity.

In an aspect, the reversible ratchet device includes a ratchet body having a cavity therein, and a pawl carrier disposed within the cavity of the ratchet body and operable for selecting a drive direction. The pawl carrier is operably coupled to a first pawl rotatable about a central portion thereof when the pawl carrier is rotated. The reversible ratchet device further includes a ratchet gear having a drive portion and a toothed portion. The toothed portion of the ratchet gear is rotatably disposed within the cavity of the ratchet body and engageable with the first pawl. The drive portion of the ratchet gear projects out of the cavity of the ratchet body and is engageable for transmitting torque from operation of the reversible ratchet device. The reversible ratchet device additionally includes a cover plate attachable to the ratchet body for closing the cavity. The cover plate has an aperture configured to receive the drive portion of the ratchet gear such that the ratchet gear projects out of the cavity.

In another aspect, the reversible ratchet device incudes a ratchet body having a cavity therein, and a ratchet gear having a drive portion and a toothed portion. The toothed portion is rotatably disposed within the cavity of the ratchet body. The drive portion projects out of the cavity of the ratchet body and is engageable for transmitting torque from operation of the reversible ratchet device. The reversible ratchet device also includes a pawl carrier within the cavity of the ratchet body. The pawl carrier is operatively coupled to at least one pawl selectively engageable with the toothed portion of the ratchet gear for a selected drive direction. The at least one pawl is rotatable about a central portion thereof when the pawl carrier is operated on. The reversible ratchet device additionally includes a cover plate attachable to the ratchet body for closing the cavity. The cover plate has an aperture configured to receive the drive portion of the ratchet gear such that the drive portion projects out of the cavity of the aperture.

In a further aspect, the reversible ratchet device includes a ratchet body having a cavity therein. The ratchet body also has a first side with a first body opening that communicates with the cavity. The reversible ratchet device also includes a reversing lever at least partially disposed within the cavity of the ratchet body through the first body opening. The reversible ratchet device further includes a pawl carrier operatively coupled to at least one pawl and selectively coupled with the reversing lever within the ratchet body. The at least one pawl is rotatable about a central portion thereof when the pawl carrier is operated on by the reversing lever. The reversible ratchet device additionally includes a ratchet gear having a drive portion and a toothed portion. The toothed portion is rotatably disposed within the cavity of the ratchet body and is engageble with the at least one pawl. The drive portion projects out of the cavity of the ratchet body and is engageable for transmitting torque from operation of the device. The reversible ratchet device moreover includes a cover plate attachable to the first side of the ratchet body for closing the cavity. The cover plate has an aperture configured to receive the drive portion of the ratchet gear.

BRIEF DESCRIPTION OF DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 1:
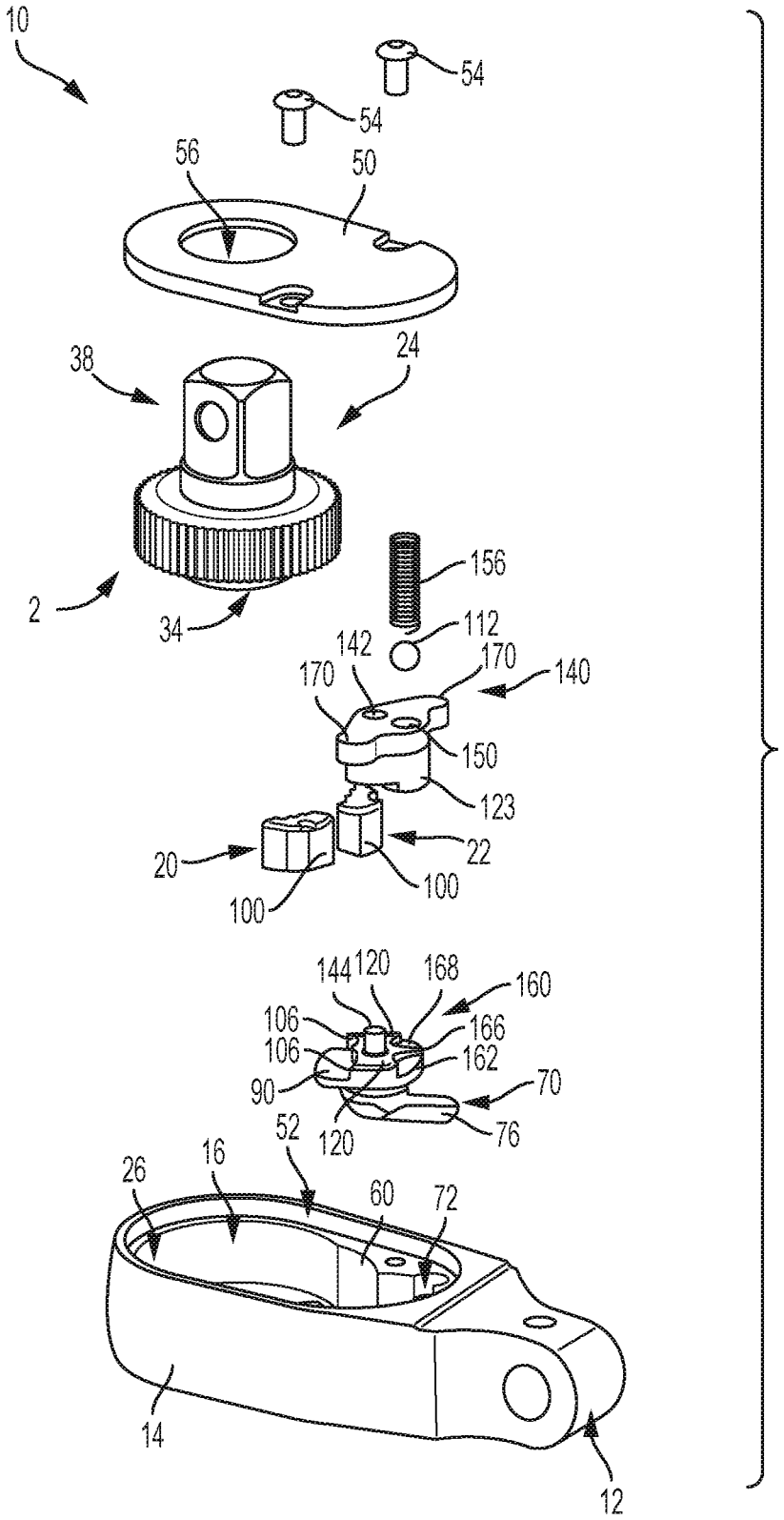
FIG. 1 is an exploded perspective view of a head of a ratchet tool in accordance with the present disclosure.

While the present invention is susceptible of embodiments in many different forms, there is shown in the drawings, and will herein be described in detail, embodiments, including a preferred embodiment, of the invention with the understanding that the present disclosure is to be considered as an exemplification of the principles of the invention and is not intended to limit the broad aspect of the invention to any one or more of the embodiments illustrated or disclosed. As used herein, the term "present invention" is not intended to limit the scope of the claimed invention, and is instead a term used to discuss exemplary embodiments of the invention for explanatory purposes only.

Embodiments of the present disclosure broadly comprise a tool, such as a fine tooth ratchet wrench. The a fine tooth ratchet wrench includes a pawl mechanism for selectively engaging a ratchet gear in first and second drive directions. The pawl mechanism includes at least one pawl and at least one recess that at least partially houses the at least one pawl. The at least one pawl is rotatable about a central portion thereof within the recess when the pawl mechanism is operated between the first and second drive directions. The present disclosure allows for fine tooth, and other, ratchet wrenches to be manufactured with less cost and complexity.

Figure 2:
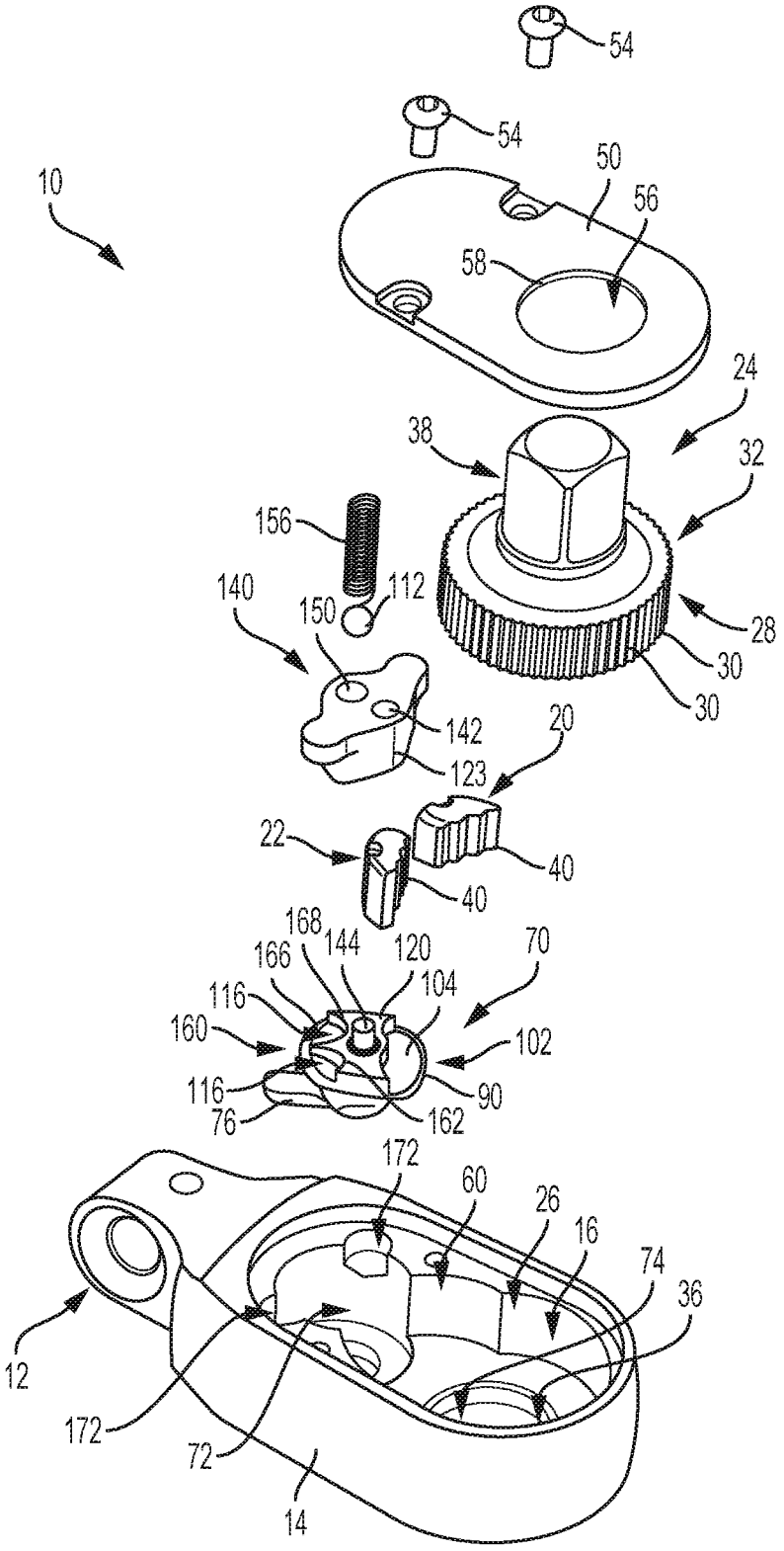
FIG. 2 is a second exploded perspective view of the ratchet tool head of FIG. 1.

Referring initially to FIGS. 1 and 2, a ratchet head 10 is depicted. While the ratchet head 10 is shown as having a connection end 12 for connecting with a yoke on an elongated handle, it should be appreciated that the ratchet head 10 may have an integrated handle. The ratchet head 10 includes a body 14 including the connection end 12 and having a cavity 16 for receiving internal and external components of the ratchet head 10 for providing torque to a working piece (not shown) such as a socket or other tool, and/or a fastener.

The ratchet head 10 is of a type of dual-pawl ratchet wrench that allows a user to selectively determine a torque direction. More specifically, the ratchet head 10 includes first and second pawls 20, 22 that are selectively engaged with a ratchet gear 24, the ratchet gear 24 being operatively engageable with a work piece. When the first pawl 20 is engaged with the ratchet gear 24, torque drive is permitted with rotation of the ratchet head 10 in a first rotational drive direction while slippage occurs with rotation of the ratchet head 10 in a second rotational drive direction opposite the first. Conversely, when the second pawl 22 is engaged with the ratchet gear 24, the first pawl 20 moves out of engagement with the ratchet gear 24, and torque drive is permitted with rotation of the ratchet head 10 in the second drive direction while slippage occurs in the first drive direction.

As can be seen, the cavity 16 includes several portions for receiving and retaining the components therein. The ratchet gear 24 is received in a first large generally circular portion of the cavity 16, referred to herein as the drive cavity 26. The ratchet gear 24 has a generally circular body portion 28 with ratchet teeth 30 on a circumferential surface 32, and a drive post or lug 38, which may be a drive square. The ratchet teeth 30 engage with pawl teeth 40 formed on the pawls 20, 22 for selective engagement with the pawls 20, 22 to provide drive through the drive post 38. The ratchet gear 24 may also have a circular lower bearing portion 34 received in a circular recess 36 below the drive cavity 26, though this may be omitted, with the bearing portion 34 assisting in centering and retaining the ratchet gear 24 within the cavity 16. Once the ratchet head 10 is assembled, a cover plate 50 is secured with the body 14 in an upper portion 52 of the cavity 16, such as by screws 54. The cover plate 50 includes a circular bore 56 through which the drive post 38 projects for operative engagement with a work piece. The circular bore 56 also defines a bearing surface 58 (illustrated in FIG. 2) for the drive post 38 to retain and position the ratchet gear 24.

The pawls 20, 22 are located in a further portion of the cavity 16, referred to herein as the pawl cavity 60. The drive cavity 26 and pawl cavity 60 overlap or communicate to permit the pawls 20, 22 to move into and out of engagement with the ratchet teeth 30 of the ratchet gear 24.

Figure 3:
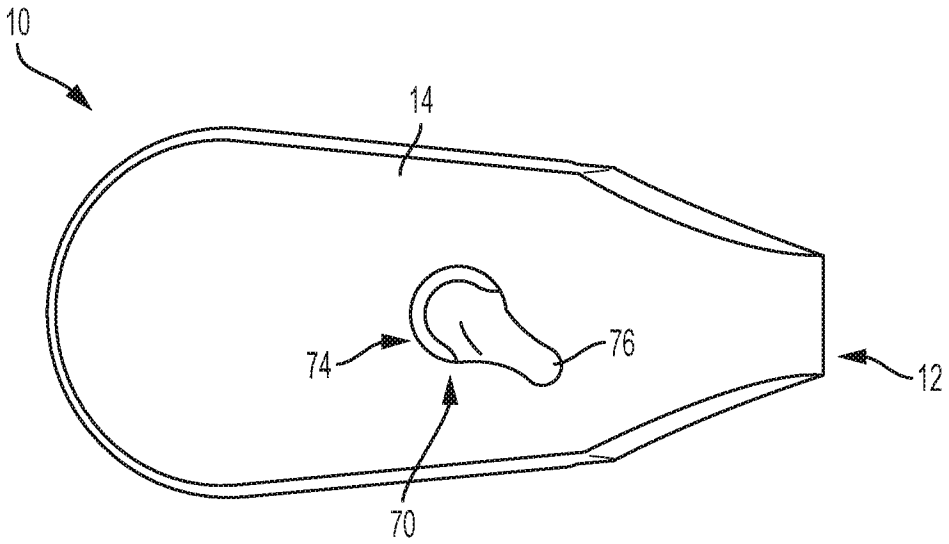
FIG. 3 is a bottom plan view of an assembled ratchet tool head of FIG. 1.

As will be discussed in greater detail below, an actuator for selectively engaging and disengaging the pawls 20, 22 with the ratchet gear 24 is provided, referred to herein as a reversing lever 70. The reversing lever 70 is received in a further circular cavity portion of the cavity 16, referred to herein as the actuator cavity 72 (illustrated in FIGS. 1 and 2). A throughbore 74 (illustrated in FIG. 2) is provided on the bottom of the body 14. The reversing lever 70 may extend from the actuator cavity 72 through the throughbore 74 so that an actuator portion in the form of a lever portion 76 of the reversing lever 70 is positioned on the outside of the ratchet head 10 and is manually operated to select a drive direction by a user, as best viewed in FIG. 3. A seal (not illustrated) is positioned around the portion of the reversing lever 70 disposed in the throughbore 74 to impede or prevent contaminants from entering the working portions of the ratchet head 10. The reversing lever 70 is assembled with the body 14 by inserting the lever portion 76 of the reversing lever 70 into the actuator cavity 72 from a first side of the ratchet body 14 (the upper side as viewed in FIGS. 1 and 2), and by extending the lever portion 76 through the throughbore 74 to a second side of the ratchet body 14, which promotes the ability to utilize the seal for preventing ingress of contaminants. The lever 70 has a portion that is sized to prevent passage through the throughbore 74, so that the lever 70 can be mounted in only one direction. The seal is somewhat compressed and/or held in position between the body 14 and the reversing lever 70 by the position of the reversing lever 70, which is itself held in position by a spacer 140, discussed below, which is held in place by the cover plate 50.

Figure 4:
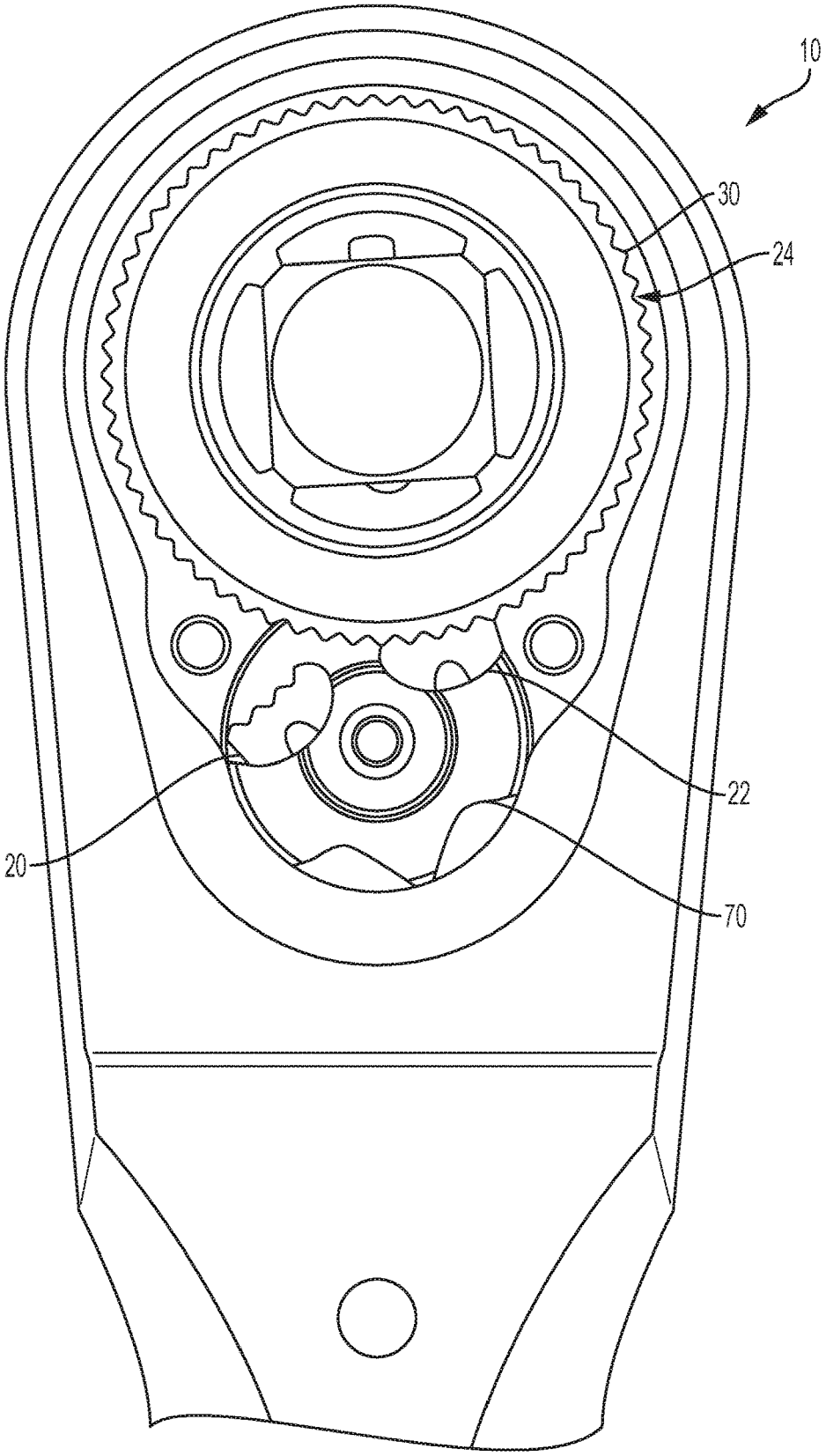
FIG. 4 is an enlarged top plan view of the assembled ratchet head of FIG. 1 with a cover and spacer removed.
Figure 5:
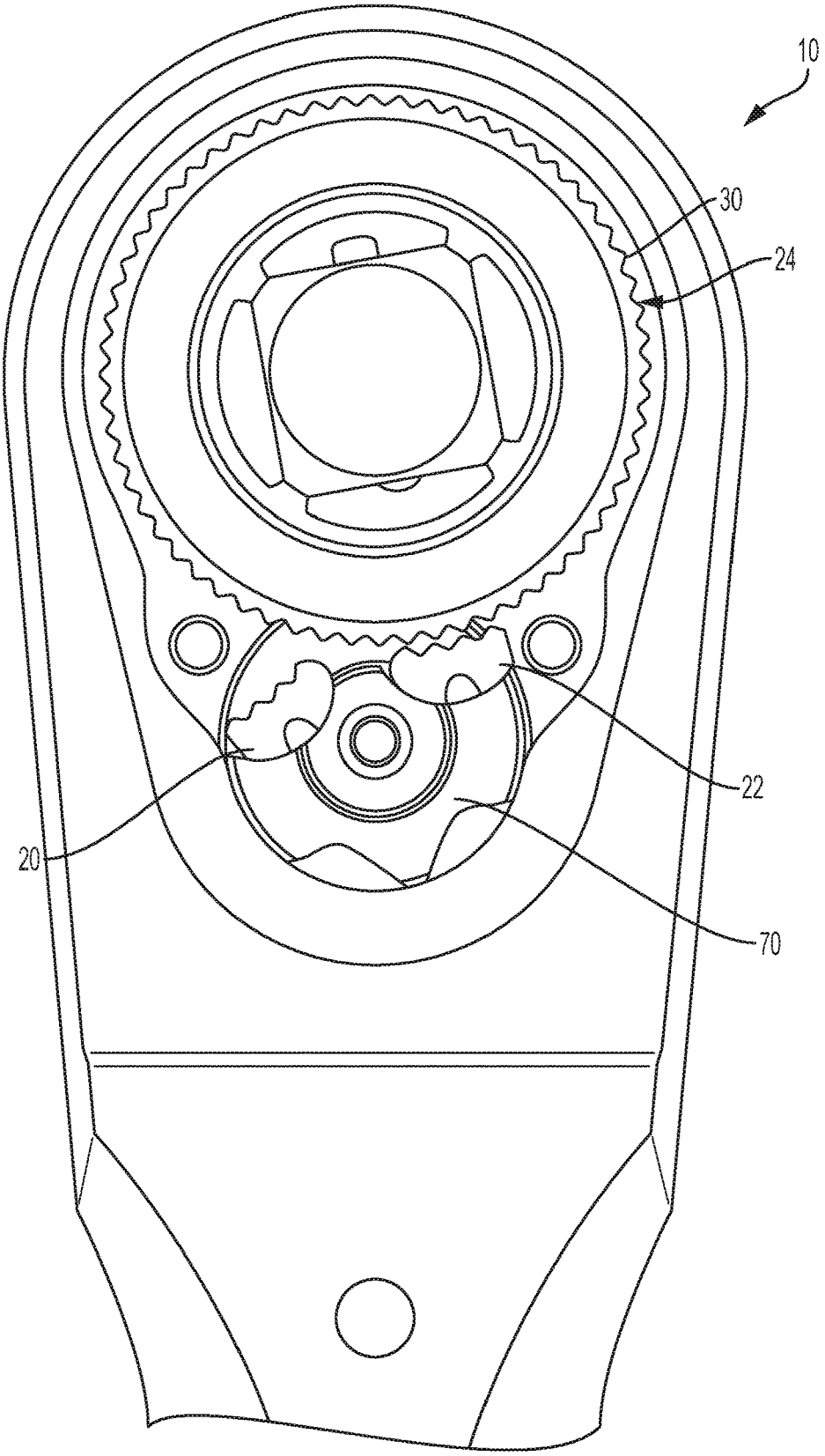
FIG. 5 is a second enlarged top plan view of the assembled ratchet head of FIG. 1 with a cover and spacer removed.

As described, the reversing lever 70 is selectively positioned to select one of the pawls 20, 22 for selecting a drive direction. The components of the reversing lever 70, except the lever portion 76, may collectively be referred to as a pawl carrier 160. In order to effect this selection, the pawl carrier 160 includes a reversing disc portion 90, below which the seal is compressed. Each of the pawls 20, 22 has an arcuate surface 100 for being manipulated by the pawl carrier 160. More specifically, the pawl carrier 160 has two recesses 102 defined by a surface 104 and by recess walls 106. The recess walls 106 may have a concavity or convexity similar or identical to that of the arcuate surfaces 100 of the pawls 20, 22. The recess walls 106 may have thicknesses similar or identical to thicknesses of the pawls 20, 22, or the thicknesses of the recess walls 106 may be different from the thicknesses of the pawls 20, 22. With reference to FIG. 4, as the pawl carrier 160 is shifted to one position for a first drive direction, a first recess wall **106*a* causes a corresponding pawl, for example the first pawl 20, to engage the ratchet gear 24. Simultaneously, a second recess 106*b* causes a corresponding pawl, for example the second pawl 22, to disengage the ratchet gear 24. As the pawl carrier 160 shifts due to movement of the lever 70, the pawls 20, 22 rotate about central portions of the pawls 20, 22 within the recesses 102. This allows the pawls 20, 22 to minimize gear rotation required to advance the pawl to the next tooth. As illustrated in FIG. 4, pawl teeth 40 remain in continued engagement with the teeth 30 of the ratchet gear 24 when the ratchet head 10 is moved in a drive direction. As illustrated in FIG. 5, the pawl deflects away from the ratchet teeth 30 when a drive direction is selected but the ratchet head 10** is rotated in reverse, in an opposite direction, to allow slippage in that direction.

As noted above, a spacer 140 is provided to position the reversing lever 70. In greater detail, the reversing lever 70 is positioned between the ratchet body 14 and the spacer 140, and the spacer 140 abuts a bottom side of the cover plate 50. The spacer 140 includes a recess 142 into which a portion of the reversing lever 70 is received. This portion is an upstanding post 144, forming a pivot, with a generally circular geometry (FIGS. 1, 2, 4, and 5), and the recess 142 is generally circular so as to form a pivot or bearing surface with the reversing lever post 144.

The ratchet head 10 is preferably designed to promote a tactile feel for a user to identify when the reversing lever 70 is in a proper position for the two drive directions. Towards this end, a ball and detent structure are provided, as is common in devices of this type. More specifically, the spacer 140 has a throughbore 150 into which a ball 112 is inserted from an upper opening of the throughbore 150 so that the ball 112 is positioned proximate a lower opening in the throughbore 150. A spring 156 is then inserted into the throughbore 150 via the upper opening. The spring 156 contacts and is retained in the throughbore 150 by the cover plate 50. In this manner, assembling the ball 112 and spring 156 is simplified, and manufacturing of the ratchet head 10 is simplified by not having to balance or otherwise hold the ball 112 on the spring 156 during assembly, as is the case for prior art devices.

The spacer throughbore 150 is positioned outboard from the center of rotation of the reversing lever 70. Therefore, as the reversing lever 70 is rotated, the ball 112 contacts and moves along a surface of the disc portion 90. More specifically, the surface of the disc portion 90 includes a pair of detents or troughs 116 positioned thereon to correspond to proper positions for the ball 112 when the reversing lever 70 is in the proper position for the first and second drive directions. The surface of the disc portion 90 includes first and second ramps 162 that meet generally between the troughs 116, at a peak 166 though the peak 166 is positioned along an arc in consideration of the rotation of the reversing lever 70 relative to the ball 112 positioned in the spacer throughbore 150. Preferably, the ramps 162 are linear or flat (rise and run are in direct relation).

With the reversing lever 70 in an initial position with the ball 112 positioned in a first of the troughs 116, the reversing lever 70 may be rotated thereby forcing the ball 112 to ride up one of the ramps 162 and forcing the spring 156 to compress. Once the ball 112 passes over the meeting point or peak 166 where the ramps 162 meet, the spring 156 provides a bias to advance the reversing lever 70 towards a second of the troughs 116. When the ball 112 is aligned with one of the troughs 116, the ball 112 at least partially extends from the spacer throughbore 150. Each of the troughs 116 is partially defined or shaped with a wall portion 168 extending upwardly with which the ball 112 comes into contact when the reversing lever 70 has reached the proper position.

The spacer 140 is easily mounted in the ratchet body 14. The spacer 140 includes at least one and preferably two portions 170 having complementary shapes to portions of the ratchet body 14 so that the spacer 140 may be assembled easily, such as in a linear fashion, into a defined position. In the present form, the spacer portions 170 are in the form of partially circular wings or ears that are received in ear recesses 172 formed in the sides of the actuator cavity 72. In this manner, the spacer 140 may be properly positioned easily, and the cover plate 50 abutting a top surface of the spacer 140 prevents the spacer 140 from moving from the assembled positioned, without the need for screws or other securements.

In order to promote the tactile feel for the user, as well as to promote rotation of a proper amount, a stop mechanism is provided. In the present form, this stop mechanism is provided by a structure formed on the reversing disc portion 90 and the spacer 140. However, it should be noted that the structure may be provided on any portion of the components used for reversing the direction and on any portion of the components that remain relatively stationary when the reversing lever 70 is being moved. Here, the reversing disc portion 90 includes first and second stop surfaces 120 formed proximate the troughs 116, as best seen in FIG. 2. Rotation of the reversing lever 70 causes the stop surfaces 120 to move into contact with stops formed on a portion of the spacer 140. In this manner, over-rotation of the reversing lever 70 is prevented, and the user is provided with a positive tactile feel of full rotation.

It should also be noted that the ratchet head 10, as described, simplifies manufacturing costs and labor. The reversing lever 70 is inserted into the cavity 16 so that the lever portion 76 extends from the throughbore 74, and is sealed therewith by a seal. The ratchet gear 24 is inserted into the cavity 16 with the bearing portion 34 received in the recess 36. The pawls 20, 22 are positioned within the cavity 16 between the recess walls 106 and the ratchet gear 24, and above the reversing disc portion 90. The spacer 140 is inserted with the spacer 140 resting between the reversing lever stop surfaces 120, the ears 170 being received in the ear recesses. The ball 112 is inserted into the throughbore 150, and then the spring 156 associated with the ball 112. The cover plate 50 is then installed such as with the two screws 54. The spacer 140 is restricted from shifting upward by the cover plate 50, and from shifting downward by its cooperation with the reversing lever post 144. Generally, the design of the ratchet head 10 serves to retain and position each component with the ratchet body 14, with the cover plate 50, or through cooperation with one of the other components, thus minimizing the use of screws or other securements, for instance, and other manufacturing steps common to assembling dual ratchet wrenches.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A reversible ratchet device comprising:

a ratchet body having a cavity;

a ratchet gear having a drive portion and a toothed portion, wherein the ratchet gear is rotatably disposed in the cavity, and wherein the drive portion projects outwardly from the cavity and is adapted to transmit torque to a work piece by operation of the device; and a pawl carrier disposed in the cavity and operatively coupled to first and second pawls that respectively have first and second pawl central portions, the first and second pawls are selectively engageable with the toothed portion for selecting one of either first and second drive directions, and the first and second pawls respectively rotate about the first and second pawl central portions while the pawl carrier is rotated to cause selection of one of the first and second drive directions, wherein the first drive direction is selected when the first pawl is engaged with the toothed portion and the second pawl is disengaged from the toothed portion, and the second drive direction is selected when the first pawl is disengaged from the toothed portion and the second pawl is engaged with the toothed portion.

2. The reversible ratchet device of claim 1, further comprising a reversing lever coupled with the pawl carrier.

3. The reversible ratchet device of claim 1, wherein the pawl carrier includes a recess, and wherein each of the first and second pawls respectively rotates about the first and second pawl central portions within the recess.

4. The reversible ratchet device of claim 3, wherein the recess includes first and second recess walls, and the first and second pawls respectively include first and second arcuate surfaces, and wherein the first and second arcuate surfaces respectively abut the first and second recess walls when the pawl carrier is rotated.

5. The reversible ratchet device of claim 1, further comprising a reversing lever coupled to the pawl carrier, wherein the reversing lever is operable for selecting one of the first and second drive directions, the reversing lever is movable between and to first and second lever positions respectively corresponding to the first and second drive directions.

6. The reversible ratchet device of claim 1, further comprising a cover plate attachable to the ratchet body for closing the cavity, wherein the cover plate has an aperture that is adapted to receive the drive portion.

7. The reversible ratchet device of claim 6, further comprising:

a spacer disposed in the cavity between the pawl carrier and the cover plate;

a throughbore formed in the spacer, wherein the throughbore includes a first bore opening proximate to the pawl carrier and a second bore opening distal to the pawl carrier, wherein the pawl carrier is rotatable with respect to the throughbore and has an axis of rotation generally parallel to the throughbore;

a spring disposed in the throughbore; and a ball disposed in the throughbore, wherein the ball is biased by the spring into engagement with a pawl carrier first recess when the first drive direction is selected, and the ball is biased by the spring into engagement with a pawl carrier second recess when the second drive direction is selected.

8. A reversible ratchet device comprising:

a ratchet body having a cavity and a side with a first body opening communicating with the cavity;

a reversing lever at least partially disposed in the cavity through the first body opening;

a pawl carrier operably coupled with the reversing lever within the cavity and operatively coupled to a first pawl having a first pawl central portion and a second pawl having a second pawl central portion, wherein the first and second pawls respectively rotate about the first and second pawl central portions while the pawl carrier is operated by the reversing lever to select one of first and second drive directions;

a ratchet gear having a toothed portion rotatably disposed in the cavity and a drive portion that projects outwardly from the cavity and that is engageable for transmitting torque by operation of the device; and a cover plate attachable to the side of the ratchet body for closing the cavity, the cover plate includes an aperture that is adapted to receive the drive portion projecting outwardly from the cavity, wherein the reversing lever is rotatable to selectively cause the first pawl to engage the toothed portion and the second pawl to disengage the toothed portion, thereby selecting the first drive direction, and the reversing lever is selectively rotatable to cause the first pawl to disengage the toothed portion and the second pawl to engage the toothed portion, thereby selecting the second drive direction.

9. The reversible ratchet device of claim 8, wherein the pawl carrier includes a recess, and wherein each of the first and second pawls respectively rotates about the first and second pawl central portions within the recess.

10. The reversible ratchet device of claim 9, wherein the recess includes first and second recess walls, wherein the first and second pawls respectively include first and second arcuate surfaces, and the first and second arcuate surfaces respectively abut the first and second recess walls when the pawl carrier is rotated.

11. The reversible ratchet device of claim 8, further comprising:

a spacer disposed in the cavity between the pawl carrier and the cover plate;

a bore formed in the spacer;

a spring disposed in the bore; and a ball disposed in the bore, wherein the ball is biased by the spring towards the reversing lever.

12. The reversible ratchet device of claim 11, wherein the reversing lever is rotatable with respect to the bore and has an axis of rotation generally parallel to the bore, the pawl carrier has an axially oriented surface with respect to the axis of rotation of the reversing lever, the pawl carrier has a first recess for receiving the spring-biased ball when the reversing lever is disposed in a first lever position, thereby selecting the first drive direction, and having a second recess for receiving the spring-biased ball when the reversing lever is disposed in a second lever position, thereby selecting the second drive direction, and wherein the pawl carrier further includes first and second stops respectively limiting rotation of the reversing lever beyond the first and second lever positions, and the first and second recesses are respectively formed between the first and second stops.

* * * * *